US005764157A

United States Patent [19]

Kudoh

[11] Patent Number: 5,764,157

[45] Date of Patent: Jun. 9, 1998

[54] RADIO PAGING RECEIVER WITH DISPLAY UNIT HAVING UPDATE MEANS TO ELIMINATE REDUNDANT MESSAGES

[75] Inventor: Kazuhiro Kudoh, Tokyo, Japan

[73] Assignee: NEC Corporation, Tokyo, Japan

[21] Appl. No.: 855,697

[22] Filed: May 8, 1997

Related U.S. Application Data

[63] Continuation of Ser. No. 544,561, Oct. 18, 1995, abandoned, which is a continuation of Ser. No. 86,844, Jul. 7, 1993, abandoned.

[30] Foreign Application Priority Data

Jul. 9, 1992 [JP] Japan ..... 4-182387
Oct. 23, 1992 [JP] Japan ..... 4-285669

[51] Int. Cl.[6] ..... G08B 5/22

[52] U.S. Cl. ..... 340/825.44; 340/825.27; 340/825.5

[58] Field of Search ..... 340/825.44, 825.27, 340/825.5, 311.1; 379/56, 57; 455/38.1; 370/314, 349

[56] References Cited

U.S. PATENT DOCUMENTS

| | | | |
|---|---|---|---|
| 4,104,624 | 8/1978 | Hamada | 340/825.27 |
| 4,237,448 | 12/1980 | Weinberg | 340/825.44 |
| 4,412,217 | 10/1983 | Willard et al. | 340/825.44 |
| 4,766,434 | 8/1988 | Matai et al. | 340/311.1 |
| 4,839,628 | 6/1989 | Davis et al. | 340/311.1 |
| 4,845,491 | 7/1989 | Fascenda et al. | 340/825.44 |
| 4,873,519 | 10/1989 | Matai et al. | 340/825.27 |
| 4,952,927 | 8/1990 | DeLuca et al. | 340/311.1 |
| 5,173,688 | 12/1992 | DeLuca et al. | 340/825.44 |
| 5,182,553 | 1/1993 | Kung | 340/825.44 |
| 5,317,621 | 5/1994 | Shibayama | 340/825.44 |

FOREIGN PATENT DOCUMENTS

| | | | |
|---|---|---|---|
| 1-16132 | 1/1989 | Japan | H04B 7/26 |
| WO86/04476 | 7/1986 | WIPO | H04Q 7/02 |
| 0317230 | 5/1989 | WIPO | G08B 3/10 |
| 9323930 | 11/1993 | WIPO | 340/825.27 |

*Primary Examiner*—Michael Horabik
*Assistant Examiner*—Edward Merz
*Attorney, Agent, or Firm*—Young & Thompson

[57] ABSTRACT

In a radio paging receiver with a display unit, a paging number corresponds to an information field to be received, a special portion of a message corresponds to an individual information item, in the information field, which is to be received, and the remaining portion of the message corresponds to information associated with the information item. The receiver comprises an input section for selecting an individual information item to be received, a storage/display section for storing and displaying an individual information item selected by the input section and information associated with the information item, and an update section for updating the storage/display section upon reception of a new message only when (a) a specific portion of the message corresponds to the selected individual information item, and (b) information associated with the information item changes.

5 Claims, 8 Drawing Sheets

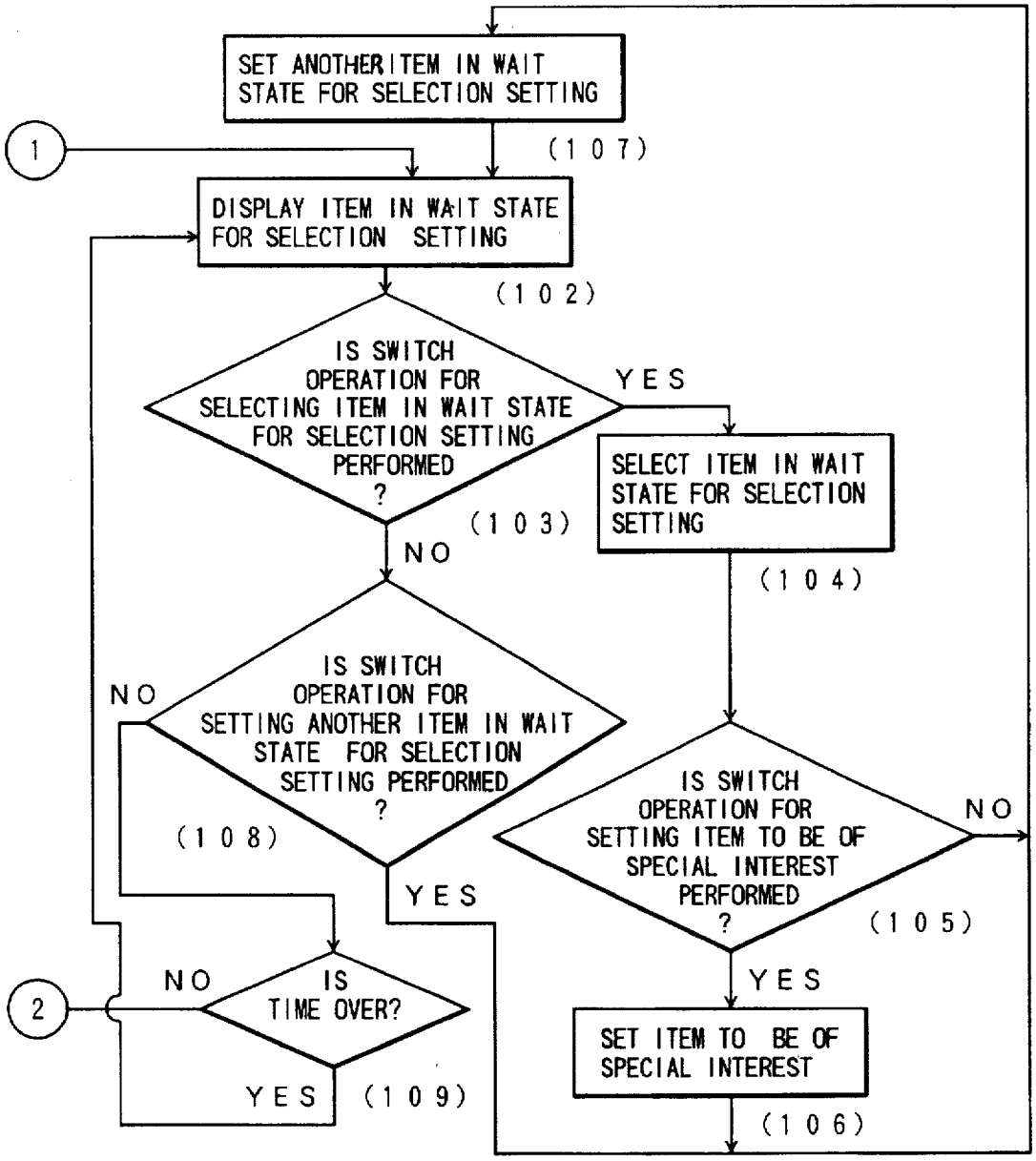
SET ANOTHER ITEM IN WAIT STATE FOR SELECTION SETTING
(107)
1
DISPLAY ITEM IN WAIT STATE FOR SELECTION SETTING
(102)
IS SWITCH OPERATION FOR SELECTING ITEM IN WAIT STATE FOR SELECTION SETTING PERFORMED ?
YES
SELECT ITEM IN WAIT STATE FOR SELECTION SETTING
(103)
NO
(104)
IS SWITCH OPERATION FOR SETTING ANOTHER ITEM IN WAIT STATE FOR SELECTION SETTING PERFORMED ?
NO
(108)
IS SWITCH OPERATION FOR SETTING ITEM TO BE OF SPECIAL INTEREST PERFORMED ?
NO
(105)
YES
YES
2
NO
IS TIME OVER?
YES
(109)
SET ITEM TO BE OF SPECIAL INTEREST
(106)

FIG. 4A

PARKING-LOT INFORMATION

YOKOHAMA STATION HIGASHIGUCHI DAIICHI FULL

YOKOHAMA STATION NISHIGUCHI CHIKA VACANT

FIG. 4B

PARKING-LOT INFORMATION

YOKOHAMA STATION HIGASHIGUCHI DAIICHI VACANT

YOKOHAMA STATION NISHIGUCHI CHIKA VACANT

RADIO PAGING RECEIVER WITH DISPLAY UNIT HAVING UPDATE MEANS TO ELIMINATE REDUNDANT MESSAGES

This application is a continuation of application Ser. No. 08/544,561, filed Oct. 18, 1995, now abandoned, which is a continuation of Ser. No. 08/086,844, filed Jul. 7, 1993, now abandoned.

BACKGROUND OF THE INVENTION

1. Field of the Invention

The present invention relates to a radio paging receiver with a display unit and, more particularly, to a radio paging receiver with a display unit which can effectively use a limited memory area.

2. Description of the Prior Art

In a conventional radio paging receiver with a display unit, a received message is stored in a memory and can be displayed upon reception. In this case, if an identical message is received, the message is not stored in the memory. Otherwise, every time a new message is received, a message display operation is performed for notification, and the message is stored in the memory.

FIG. 1 is a block diagram showing an arrangement of a conventional radio paging receiver with a display unit.

Referring to FIG. 1, a radio signal received through an antenna 21 is amplified and demodulated by a radio section 22 and is input, as a digital signal B, to a decoder 24. The decoder 24 collates an address contained in this digital signal, i.e., a paging number, with a self-address C stored in an ID memory 25. If they coincide with each other, a CPU 28 stores a message code D accompanying the address code in a message memory 26, and outputs a control signal (3) for controlling a notification/display means 27 to perform a notification and display a message E. Reading of the self-address C from the ID memory 25 is performed by using a control signal (1) from the decoder 24 and reading/writing of the message D from/in the message memory 26 is performed by using a control signal (2) from the CPU 28. If the received message is stored in the message memory 26, the message D or E stored in the message memory 26 can be displayed by the notification/display means 27 using control signals (2) and (3) from the CPU 28. A control section 23 consists of the decoder 24 and the CPU 28.

In the conventional radio paging receiver with a display unit, however, if a large number of similar messages and messages whose contents change with time in association with specific items are received, a large number of unnecessary messages, confusing messages, and messages expressing the current states of specific contents are stored. Consequently, a cumbersome operation is required to select a useful message, and a limited message memory area cannot be effectively used, resulting in a large increase in transmitted data.

SUMMARY OF THE INVENTION

It is an object of the present invention to provide a radio paging receiver with a display unit, in which only one latest message associated with an item defined by a specific character and symbol train, i.e., a specific item, is always stored, and old messages with little necessity and confusing messages are automatically removed when a large number of similar messages and messages whose contents change with time in association with specific items are received, whereby selection of a useful message is facilitated in a message display operation, and the limited message memory area can be effectively used.

In order to achieve the above object, according to the first aspect of the present invention, a radio paging receiver with a display unit comprises a first memory for storing a specific character and symbol train, and a second memory for storing a received message. Message collating means are also provided for determining whether the specific character and symbol train is contained in the received message as well as second memory control means for controlling storage of the received message in the second memory on the basis of the determination result obtained by the message collating means.

According to the second aspect of the present invention, in the radio paging receiver with a display unit according to the first aspect, when the message collating means determines that a first message containing the specific character and symbol train has already been stored in the second memory, and the specific character and symbol train is also contained in a newly received second message, the second memory control means erases the first message and causes the second memory to newly store the second message.

According to the third aspect of the present invention, the radio paging receiver with a display unit according to the first aspect further comprises input means for selecting an individual information item to be received, storage/display means for storing and displaying the individual information item selected by the input means and information associated with the information item, and update means for updating the storage/display means upon reception of a new message only when a specific portion of the message corresponds to the selected individual information item, and contents of information associated with the information item change. The received paging number is contained in a received information field, a specific portion of a received message corresponds to an individual information item, in the information field, which is to be received, and a remaining portion of the message corresponds to information associated with the information item.

In addition, according to the fourth aspect of the present invention, the radio paging receiver with a display unit according to the third aspect further comprises input means for, when the individual information item to be received is selected, further selecting an important individual information item, and notifying means for performing a special notification when contents of information associated with the selected important individual information item change.

According to the radio paging receiver with a display unit of the present invention, it is checked whether a specific character and symbol train is contained in a received message. If it is determined that a first message containing the specific character and symbol train has already been stored in the second memory, and the specific character and symbol train is also contained in a newly received second message, the first message is erased, and the second message is stored in the second memory. With this operation, when a new message associated with an item defined by a specific character and symbol train, i.e., a specific item, is received, an old message stored in the message memory is erased, and one latest message can be stored. Therefore, only one latest message associated with an item defined by a specific character and symbol train, i.e., a specific item, is always stored, and old messages with little necessity and confusing messages are automatically removed when a large number of similar messages and messages whose contents change with time in association with specific items are received, whereby selection of a useful message is facilitated in a message display operation, and the limited message memory area can be effectively used.

In addition, according to the present invention, in the radio paging receiver with a display unit, an individual information item to be received is selected, and the selected individual information item and information associated therewith are stored and displayed. The stored contents are replaced with a newly received message only when a specific portion of the received message corresponds to a selected information item, and the contents of information associated with the information item change. After an individual information item to be received is selected, an important individual information item is further selected. If the contents of information associated with the selected important individual information item change, a special notification is performed. With this operation, when a large number of messages whose contents change with time with respect to specific items are received, messages indicating the current states of specific contents can be efficiently received. A large number of old messages with little necessity and confusing messages are not stored, and a cumbersome operation of selecting a useful message need not be performed. Therefore, a limited message memory area can be effectively used, and information which are required to be obtained in real time can be effectively ensured.

The above and many other advantages, features and additional objects of the present invention will become manifest to those versed in the art upon making reference to the following detailed description and accompanying drawings in which preferred structural embodiments incorporating the principles of the present invention are shown by way of illustrative example.

BRIEF DESCRIPTION OF THE DRAWINGS

FIGS. 3A and 3B together form a flow chart associated with an operation of the embodiment shown in FIG. 2;

FIGS. 4A and 4B illustrate display samples in the embodiment shown in FIG. 2;

DETAILED DESCRIPTION OF THE PREFERRED EMBODIMENTS

The present invention will be described in more detail below in association with the preferred embodiments shown in the accompanying drawings.

Figure 1:
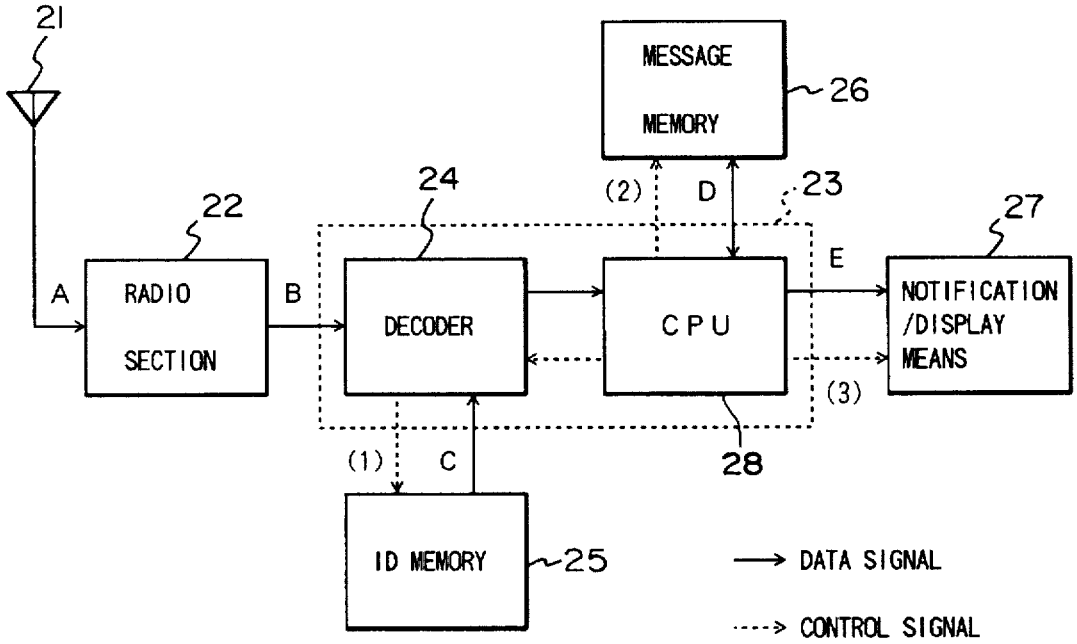
FIG. 1 PRIOR ART
FIG. 1 is a block diagram showing the arrangement of a conventional radio paging receiver with a display unit.
Figure 2:
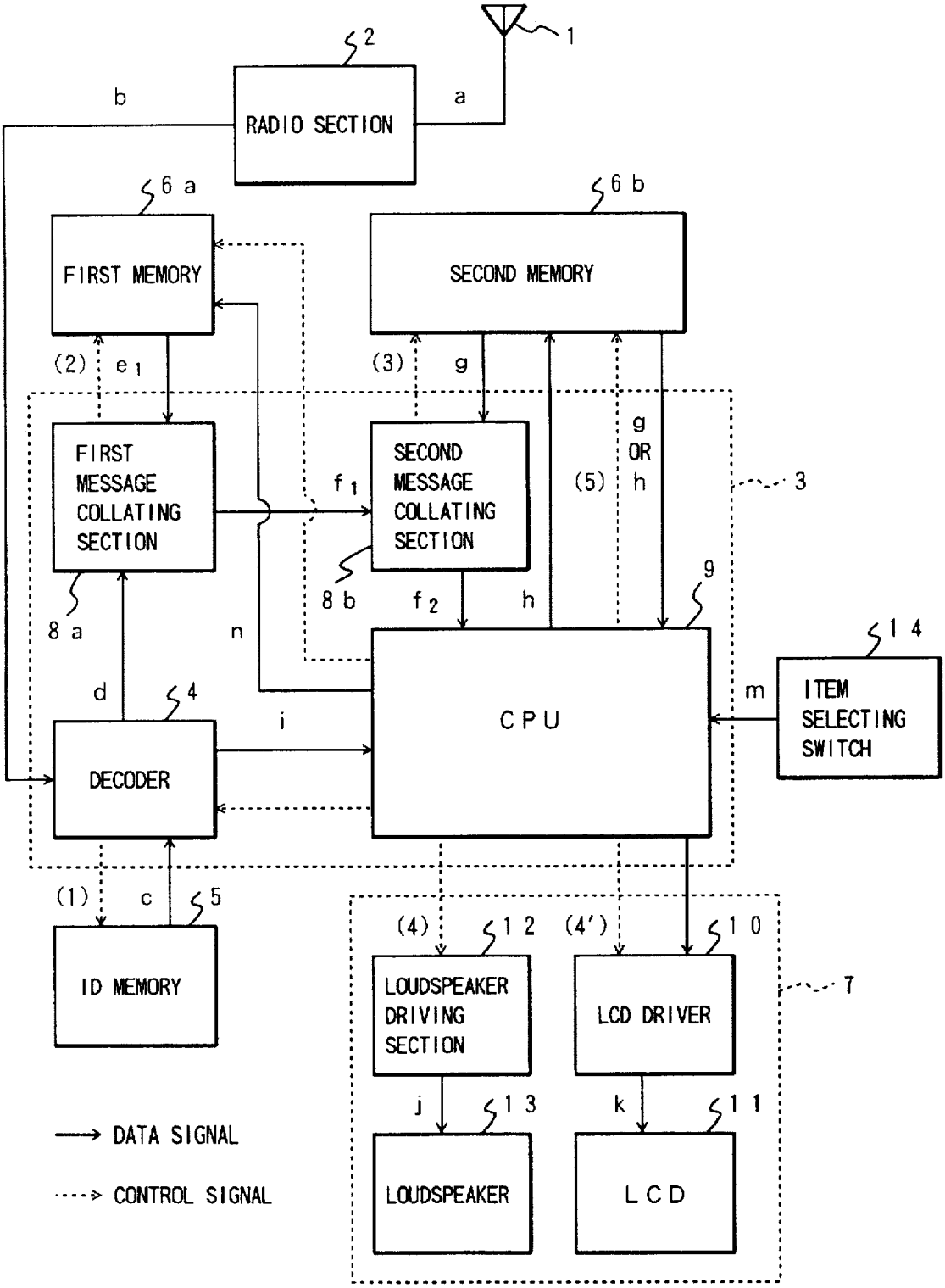
FIG. 2 is a block diagram showing the arrangement of an embodiment of the present invention.

The embodiment shown in FIG. 2 comprises an antenna 1, a radio section 2 for demodulating a received input signal a to output a digital signal b as a paging number, a decoder 4 for receiving and decoding the output signal b from the radio section 2, an ID memory 5 for storing a self-address, a first memory 6*a* for storing both a preset individual information item and information indicating whether the individual information item is selected as a desired reception item by a carrier of the receiver, a first message collating section 8*a* for collating a message code output from the decoder 4 with the individual information item in the first memory 6*a*, a CPU 9, a second memory 6*b* for storing detailed information associated with a selected individual information item sent through a message, and a second message collating section 8*b* for receiving the information associated with the selected individual information item from the first message collating section 8*a*, collating the information with the stored contents of the second memory 6*b* to check a change in information contents, and sending the resultant data to the CPU 9. The embodiment also comprises an LCD driver 10, an LCD 11, a loudspeaker driving section 12, and a loudspeaker 13, which are included in a notification/display means 7, and an item selecting switch 14 for setting an individual information item. As is apparent from FIG. 2, a control section 3 is constituted by the first and second message collating sections 8*a* and 8*b*, the decoder 4, and the CPU 9.

Of these components, the item selecting switch 14 and its cooperative components such as the CPU 9, the LCD driver 10, the LCD11, the first memory 6*a* constitute an input means; the second memory 6*b*, the CPU 9, the LCD driver 10, and the LCD 11 constitute a storage/display means; the first and second message collating sections 8*a* and 8*b*, and the second memory 6*b* constitute an update means; and the first and second memories 6*a* and 6*b*, the first and second message collating sections 8*a* and 8*b*, the CPU 9, the LCD driver 10, the LCD 11, the loudspeaker driving section 12, and the loudspeaker 13 also serve as a notification means.

An operation of the embodiment will be described next.

The radio signal a received by the antenna 1 is amplified and demodulated by the radio section 2 and is input, as the digital signal b, to the decoder 4.

The decoder 4 collates an address contained in the digital signal b, i.e., the paging number, with a self-address c stored in the ID memory 5. When they coincide with each other, the decoder 4 outputs a message code d accompanying the address code to the first message collating section 8*a*. In this case, the self-address c is read out from the ID memory 5 under the control (1) of the decoder 4. The self-address used in this case corresponds to the field of information sent through a message, e.g., "PARKING-LOT INFORMATION" or "AIRLINE TICKET VACANCY STATE" rather than an address unique to the radio paging receiver with a display unit (to be referred to as the receiver hereinafter).

The first memory 6*a* serves to store a character and symbol train transmitted as a specific portion of a message corresponding to an individual information item preset with respect to such an address, which item is, for example, "YOKOHAMA STATION HIGASHIGUCHI DAIICHI" or "YOKOHAMA STATION NISHIGUCHI CHIKA" for "PARKING-LOT INFORMATION". The first memory 6*a* also stores information indicating whether such an individual information item is selected, as an item to be received, by the, carrier of the receiver.

When the message code d is input to the first message collating section 8*a*, a selected individual information item $e_1$ stored in the first memory 6*a* is referred to (control (2)), and a specific portion of the message is collated with the selected individual item to check whether they correspond to each other. A collation result $f_1$ is output to the second message collating section 8*b*.

Information g transmitted through the message and associated with the selected individual information item $e_1$ is stored in the second memory 6*b*. Upon reception of the collation result $f_1$ from the first message collating section 8*a*, the second message collating section 8*b* compares the information portion, of the received message, which is associated with the individual information item with the current information g by referring to the second memory 6b (control (3)) so as to check whether the contents of the information have changed. The second message collating section 8b outputs the resultant data to the CPU 9.

Upon reception of an output $f_2$ from the second message collating section 8b, which output indicates that new information associated with the individual information item is received, the CPU 9 receives a received message i from the decoder 4 and performs loudspeaker control (4) of the loudspeaker driving section 12 to cause the loudspeaker 13 to generate a notifying sound j. In addition, the CPU 9 performs driver control (4') of the LCD (Liquid Crystal Display) driver 10 to cause the LCD 11 to display a message k, and writes new information h in the second memory 6b to update the corresponding information.

As is apparent, the information g or h stored in the second memory 6b can be read out by the CPU 9 (control (5)) and can be displayed on the LCD 11 upon driver control (4') of the LCD driver 10.

In order to set each individual information item, the CPU 9 writes selected information n associated with each individual information item in the first memory 6a in response to a signal m input to the item selecting switch 14.

When an individual information item is selected using the item selecting switch 14, the selecting operation can be easily performed while displaying items of selection on the LCD 11.

When an item of special interest is selected by operating the item selecting switch 14 from those similarly selected by the operation of the item selecting switch 14, the selected information is written in the first memory 6a by the CPU 9. When it is detected that new information associated with the item is received, the CPU 9 controls the loudspeaker driving section 12 to generate a special notifying sound from the loudspeaker 13. For example, the special notifying sound may be a sound whose volume, frequency, tone, or the like is different from that of a normal notifying sound. Alternatively, in such a case, a notifying sound may be generated even in a situation wherein no notifying sound is generated upon reception of a normal item.

Figure 3A:
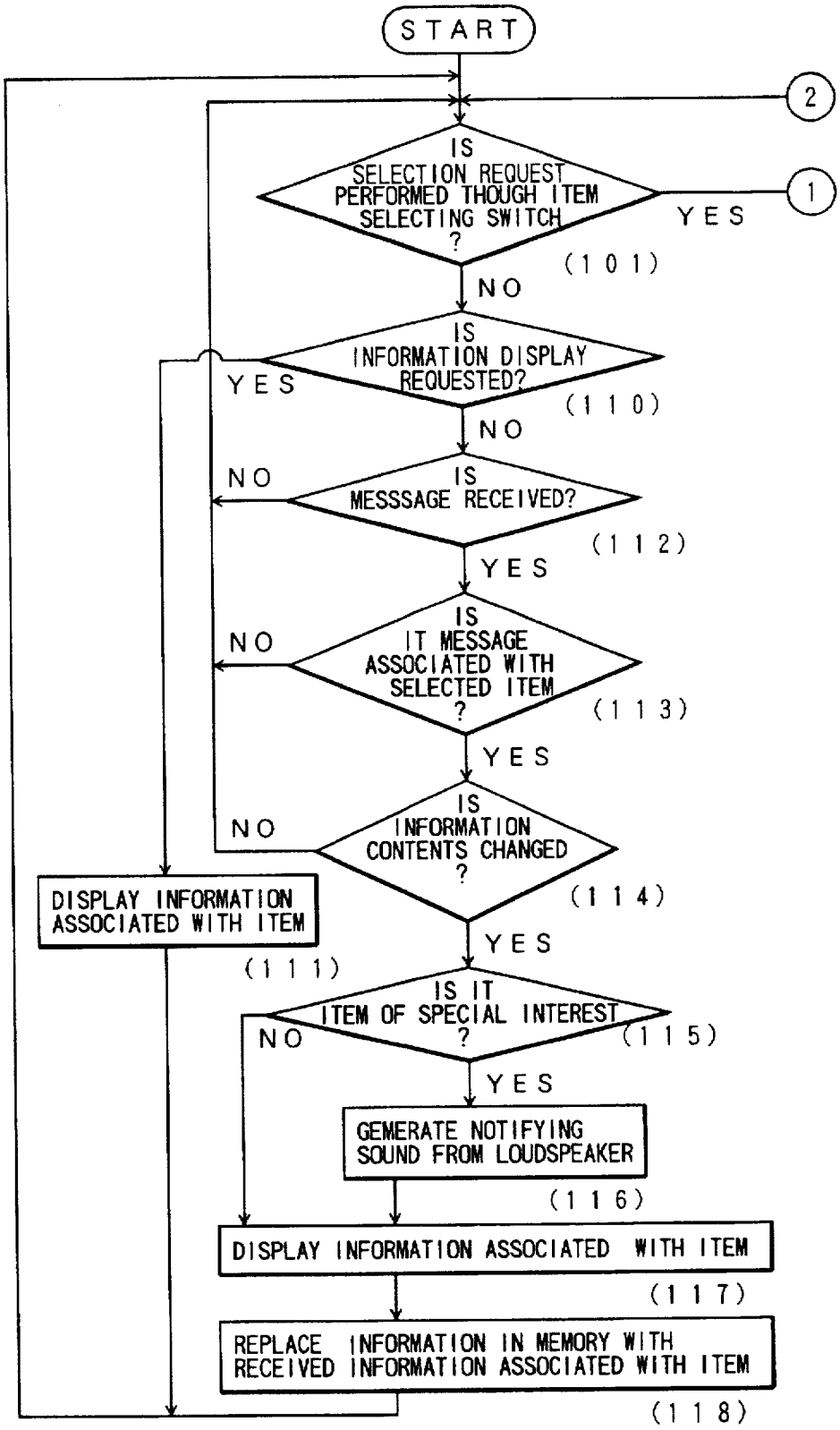

FIG. 3 is a flow chart for explaining an operation of the embodiment.

An individual information item at each address is selected by operating the item selecting switch 14 (step 101).

When an item selection mode is set, an item in a wait state for selection setting is displayed (step 102). When a switch operation for selection setting is performed (step 103), the item in the wait state for selection setting is selected (step 104).

When the item is selected, whether to set the item as an item of special interest (step 106) is determined by a switch operation (step 105), and another item is set in a wait state for selection setting (step 107).

When a switch operation is performed to set another item in a wait state for selection setting while the wait state for selection setting is displayed (steps 102 and 103), another item is set in a wait state for selection setting (step 108). When, however, a predetermined period of time elapses without operating the item selecting switch 14 (109), the item selection mode is terminated.

When a switch operation is performed to display information (step 110), information associated with each item is displayed (step 111). When a message is received (step 112), a specific portion of the message is collated with the selected item to check whether the message corresponds to the selected item (step 113). A change in the information is then checked by collating it with the latest information stored in the second memory 6b (step 114). When there is a change in the information associated with the selected item, it is checked whether the item is of special interest (step 115). When the item is of special interest, a notifying sound is generated by the loudspeaker 13 (step 116). In addition, the information associated with the item is displayed (step 117), and the received information associated with the item is written in the second memory 6b to update the corresponding information (step 118). When the item is not of a special interest (step 115), only display of the information (step 117) and updating of the information (step 118) are performed.

FIGS. 4A and 4B illustrate message display samples in the embodiment. FIG. 4A shows a display of information associated with each item. More specifically, "PARKING-LOT INFORMATION" is an information field corresponding to an address, and "YOKOHAMA STATION HIGASHIGUCHI DAIICHI" and "YOKOHAMA STATION NISHIGUCHI CHIKA" are individual information items. Two pieces of latest information "FULL" and "VACANT" are displayed on the right side of the respective items.

The frame enclosing "YOKOHAMA STATION HIGASHIGUCHI DAIICHI" indicates that the item is of special interest.

FIG. 4B shows a message display in a case wherein a new message associated with the item "YOKOHAMA STATION HIGASHIGUCHI DAIICHI" is received.

When a large number of messages which change with time are received in association with special items, useful messages are automatically selected in this manner, allowing effective use of a limited memory area and efficient acquisition of necessary information.

Another embodiment of the present invention will be described below with reference to FIGS. 5 to 7B.

Figure 5:
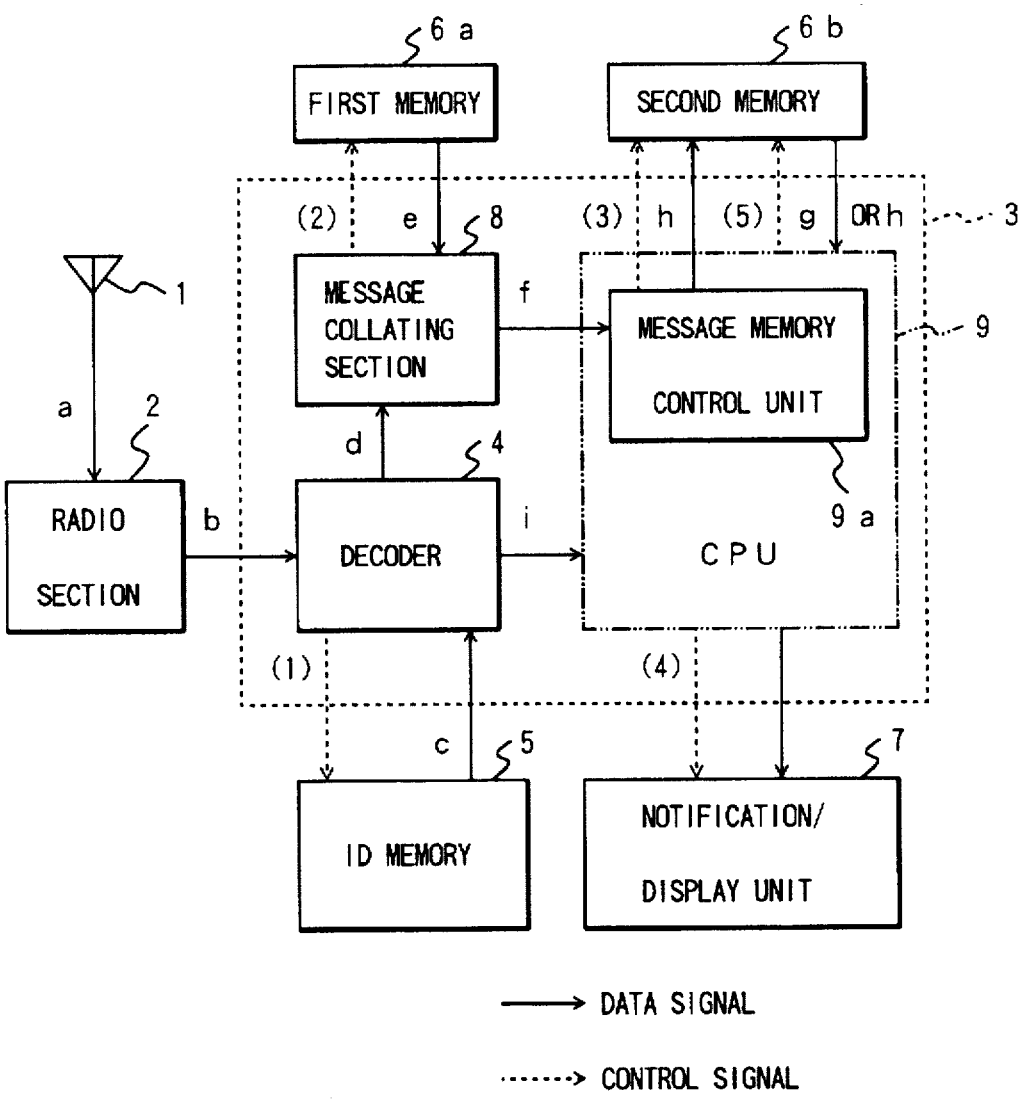
FIG. 5 is a block diagram showing the arrangement of another embodiment of the present invention.

FIG. 5 is a block diagram showing the arrangement of the second embodiment. The components denoted by the same reference numerals and symbols as those in FIG. 2 have the same functions as those of the corresponding components. Therefore, a repetitive description of these components will be avoided.

FIG. 5 shows the minimum necessary arrangement. This arrangement is different from the arrangement of the first embodiment shown in FIG. 2 in that a message memory control unit 9a is included in a CPU 9 in place of the second message collating section 8b.

An operation of the second embodiment will be described below.

A received message h is stored in a second memory 6b in the following manner. First, a message collating section 8 checks upon collation whether a message code d output from a decoder 4 contains a character and symbol train identical to a specific character and symbol train e read out (control (2)) from a first memory 6a for storing a character and symbol train. The message collating section 8 then outputs a collation result f and the message h to the message memory control unit 9a. If the collation result indicates that the special character and symbol train is not contained, the message memory control unit 9a performs control (3) through a CPU 9 to store the received message h in the second memory 6b. In contrast to this, if the collation result indicates that the special character and symbol train is contained, the message memory control unit 9a erases a message containing the same character and symbol train and stored in the second memory 6b, and causes the second memory 6b to store the newly received message h.

Figure 7A:
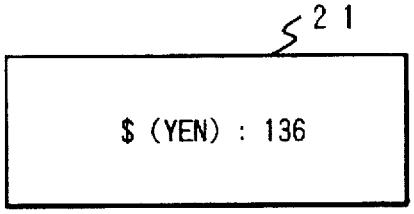
FIGS. 7A and 7B illustrate display samples in the embodiment shown in FIG. 5.
Figure 7B:
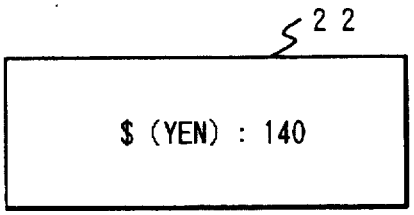

FIGS. 7A and 7B illustrate messages displayed by the radio paging receiver shown in FIG. 5. FIG. 7A shows a case wherein a message stored in the second memory 6b is displayed until a new message is received. Assume that a new message "$ (YEN): 140) is received in this state. In this case, in the receiver shown in FIG. 5, it is considered that a new message containing the selected individual information item "$ (YEN):" is received. Therefore, a message 21 shown in FIG. 7A is erased, and a message 22 shown in FIG. 7B is stored.

Figure 6:
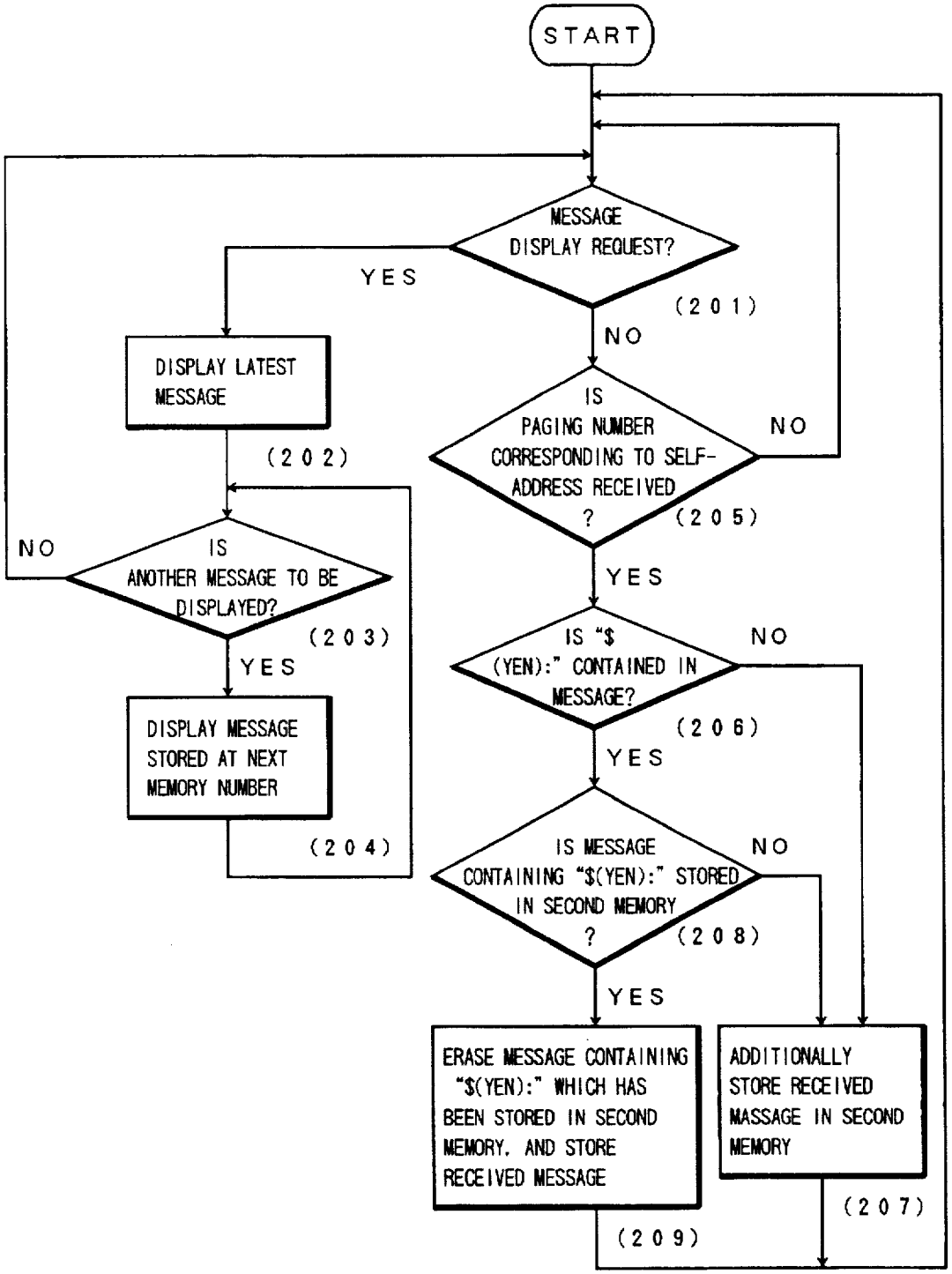
FIG. 6 is a flow chart associated with an operation of the embodiment shown in FIG. 5.

FIG. 6 is a flow chart showing an operation of the radio paging receiver with a display unit in FIG. 5. When a stored message is to be displayed (step 201), the latest message is displayed (step 202). When messages other than the latest message are to be displayed (step 203), the messages are sequentially displayed, from a message at the next memory number indicating a message storage location assigned to the second memory 6b (step 204).

When a paging number corresponding to a self-adress is received (step 205), it is checked upon collation whether a character and symbol train identical to a specific character and symbol train pre-stored in the first memory 6a is contained in the received message (step 206). In this case, the specific character and symbol train is "$ (YEN):". If "$ (YEN):" is not contained in the received message, the new message is simply stored in the second memory 6b (step 207). If, however, "$ (YEN):" is contained in the received message, it is further checked whether a message containing "$ (YEN):" is stored in the second memory 6b (step 208). If a message containing "$ (YEN):" is stored, the message is erased, and the received message is stored in the second memory 6b instead (step 209). As is apparent, if a message containing "$ (YEN):" is not stored in the second memory 6b, the received message is simply stored in the second memory 6b (step 207).

It should be understood that the foregoing relates to only preferred embodiments of the present invention, and the present invention is not limited to these embodiments. It will be obvious to those skilled in the art that various modifications and changes can be made without departing from the spirit and scope of the invention.

What is claimed is:

1. A radio paging receiver with a display unit in which a received message is compared to information stored in an ID memory to determine whether said received message contains information matching said stored information, and, if said received message contains said matching information, said received message is further compared to a selected input individual information item to determine whether said received message contains said selected input individual information item, comprising:

(a) input means for selecting an individual information item;

(b) storage/display means for storing into a common memory and displaying a received message including an individual information item selected by said input means and information associated with said selected individual information item; and (c) update means for updating a preceding message stored into said common memory of said storage/display means upon reception of a new message only when said new message contains information matching said selected individual information item of said preceding message, and only when said information associated with said selected individual information item has changed, such that a received message which has not changed relative to said preceding message is not stored in said common memory.

2. A receiver according to claim 1, wherein after said input means selects the individual information item, said input means can further select an important individual information item, and said receiver further comprises notifying means for performing a special notification when contents of the information associated with the selected individual information item change.

3. A receiver according to claim 1, wherein said input means includes a first memory for storing a special character and symbol train, a CPU for controlling said first memory, and a notification/display unit controlled by said CPU; said storage/display means includes a second memory for storing the received message, said notification/display unit and said CPU for controlling said second memory and a notification/display unit; and said update means includes a message collating unit, a message memory control unit, and said second memory.

4. A receiver according to claim 3, wherein when said message collating unit determines that a first message containing the specific character and symbol train has already been stored in said second memory and the specific character and symbol train is contained in a newly received second message, said message memory control means erases the first message and causes said second memory to store the second message.

5. A receiver according to claim 1, wherein said input means includes an item selecting switch 14 for setting the individual information item, a first memory for storing both a preset individual information item and information indicating whether the information item is selected as a desired reception item by a carrier of said receiver, a notification/display unit and a CPU for controlling said first memory and said notification/display unit; said storage/display means includes a second memory for storing information transmitted through a message and associated with a selected individual information item, a notification/display unit, and said CPU for controlling said second memory and said notification/display unit; and said update means includes said first message collating section, a second message collating section for receiving information associated with the selected individual information item from said first message collating section, collating the information with stored contents of said second memory to determine the presence/absence of a change in information contents, and outputting the determination result to said CPU, and said second memory.

* * * * *